US008599123B2

(12) United States Patent
Guo et al.

(10) Patent No.: US 8,599,123 B2
(45) Date of Patent: Dec. 3, 2013

(54) DRIVE CIRCUIT AND LIQUID CRYSTAL DISPLAY USING THE SAME

(75) Inventors: Wei Guo, Shenzhen (CN); Sha Feng, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 424 days.

(21) Appl. No.: 12/965,898

(22) Filed: Dec. 12, 2010

(65) Prior Publication Data

US 2011/0169796 A1 Jul. 14, 2011

(30) Foreign Application Priority Data

Jan. 14, 2010 (CN) ..... 2010 1 0300264

(51) Int. Cl.
*G09G 3/36* (2006.01)

(52) U.S. Cl.
USPC ..... 345/94; 345/99

(58) Field of Classification Search
USPC ..... 345/87–100, 204
See application file for complete search history.

(56) References Cited

U.S. PATENT DOCUMENTS

| | | | | |
|---|---|---|---|---|
| 8,269,704 | B2 * | 9/2012 | Jung et al. | 345/87 |
| 2007/0120799 | A1 * | 5/2007 | Tanaka et al. | 345/98 |
| 2008/0117200 | A1 * | 5/2008 | Nakatsuka | 345/87 |
| 2009/0009460 | A1 * | 1/2009 | Mizumaki | 345/94 |
| 2009/0289884 | A1 * | 11/2009 | Yanagi et al. | 345/92 |

* cited by examiner

*Primary Examiner* — Regina Liang
(74) *Attorney, Agent, or Firm* — Bacon & Thomas, PLLC

(57) ABSTRACT

A liquid crystal display includes a liquid crystal panel, a drive circuit, and a power circuit. The drive circuit includes a gate driver, a timing control circuit, and a wave signal generation circuit. The timing control circuit sends a timing control signal to the gate driver and the wave signal generation circuit. The wave signal generation circuit generates a control signal according to the timing control signal, and generates a wave signal according to the control signal. The gate driver generates scan signals according to the timing control signal and the wave signal. Before the voltage of the scan signal changes from a maximum voltage to a minimum voltage, the voltage of the scan signal decreases to an invariable middle voltage that is between the minimum voltage and the maximum voltage during a fall time of the scan signal.

18 Claims, 8 Drawing Sheets

DRIVE CIRCUIT AND LIQUID CRYSTAL DISPLAY USING THE SAME

BACKGROUND

1. Technical Field

The present disclosure relates to a drive circuit for improving display quality and a liquid crystal display (LCD) using the same.

2. Description of Related Art

LCDs include a plurality of gate lines and data lines, and an array of pixel units arranged between adjacent gate lines and data lines. Referring to FIG. 8, an enlarged circuit diagram of a pixel unit 100 of an LCD is shown. The pixel unit 100 includes a thin film transistor (TFT) 110, a liquid crystal capacitor 120, a storage capacitor 130, and a parasitic capacitor 140. A gate electrode of the TFT 110 is electronically connected to a gate line 101, a source electrode of the TFT 110 is electronically connected to a data line 102, and a drain electrode of the TFT 110 is electronically connected to the liquid crystal capacitor 120 and the storage capacitor 130. The parasitic capacitor 140 is formed between the gate electrode and the drain electrode.

A scan signal is applied to the gate line 101, and the TFT 110 is turned on when the scan signal is in a logic high state. Then, data signals applied to the data line 102 charge the liquid crystal capacitor 120 and the storage capacitor 130. When the voltage of the scan signal changes, such as from a logic high to a logic low, the voltage of the liquid crystal capacitor 120 suddenly becomes lower due to the parasitic capacitor 140. When this happens repeatedly, the brightness of the pixel unit 100 fluctuates causing flickering in the images displayed on the LCD.

Therefore, it is desired to provide a drive circuit and an LCD which can overcome the above-described deficiencies.

BRIEF DESCRIPTION OF THE DRAWINGS

Many aspects of the present drive circuit and LCD using the same can be better understood with reference to the following drawings. The components in the various drawings are not necessarily drawn to scale, the emphasis instead being placed upon clearly illustrating the principles of the present drive circuit and LCD using the same.

DETAILED DESCRIPTION

Reference is now made to the drawings to describe various embodiments of the present disclosure in detail.

Figure 1:
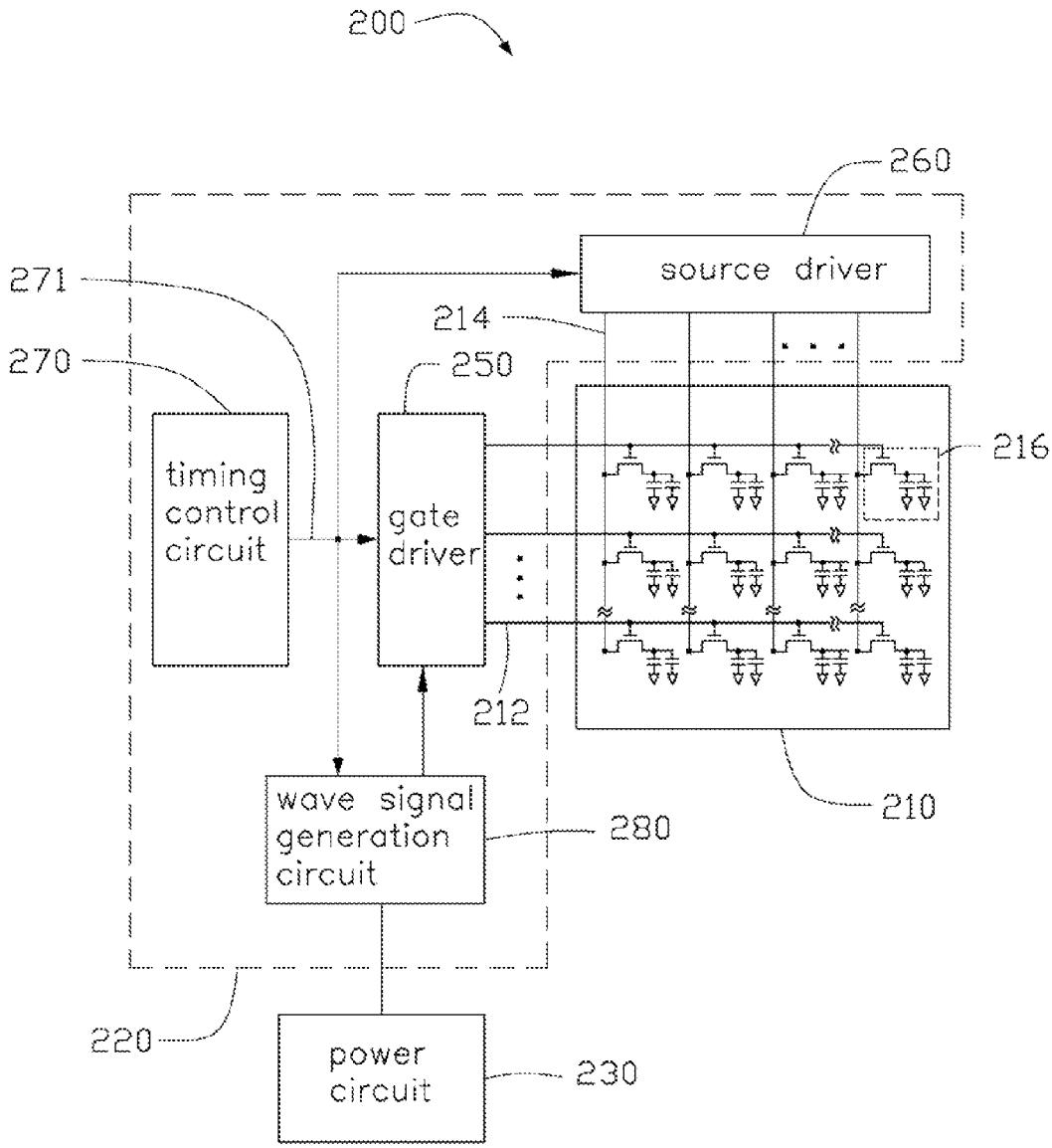
FIG. 1 is block diagram of an LCD, according to the present disclosure.

Referring to FIG. 1, an LCD 200 according to the present disclosure, includes a liquid crystal panel 210, a drive circuit 220 for driving the liquid crystal panel 210, and a power circuit 230 for providing a power supply voltage VDD to the drive circuit 220.

The liquid crystal panel 210 includes a plurality of parallel gate lines 212 extending along a first direction, a plurality of parallel data lines 214 extending along a second direction orthogonal to the first direction, and a plurality of pixel units 216 defined by the intersecting gate lines 212 and data lines 214.

The drive circuit 220 includes a gate driver 250 configured for driving the gate lines 212, a source driver 260 configured for driving the data lines 214, a timing control circuit 270, and a wave signal generation circuit 280. The timing control circuit 270 is configured for driving the gate driver 250 and the source driver 260. The timing control circuit 270 includes a connection terminal 271, and the timing control circuit 270 is electronically connected to the gate driver 250, the source driver 260, and the wave signal generation circuit 280 through the connection terminal 271. The wave signal generation circuit 280 is electronically connected between the power circuit 230 and the gate driver 250.

Figure 2:
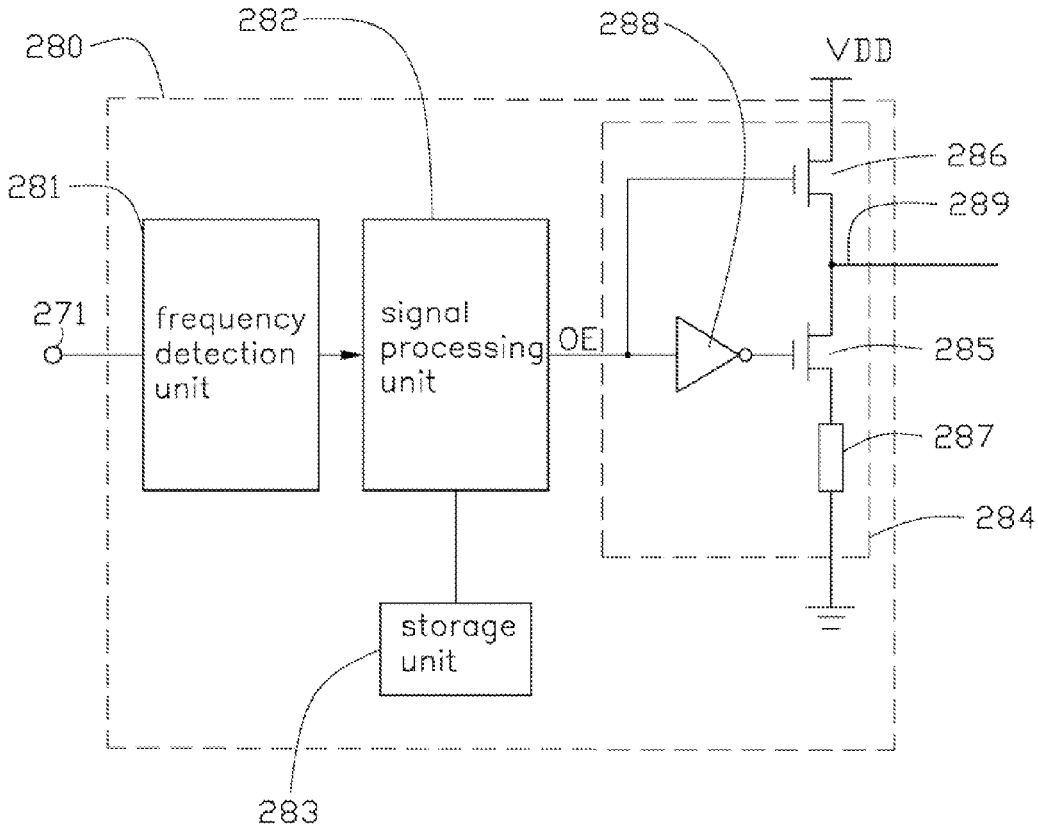
FIG. 2 is a block diagram of a wave signal generation circuit shown in FIG. 1, according to a first embodiment of the present disclosure.

Referring to FIG. 2, the wave signal generation circuit 280 according to a first embodiment of the present disclosure, includes a frequency detection unit 281, a signal processing unit 282, a storage unit 283 storing a plurality of signal frequencies respectively associated with a plurality of signal pulse widths, and a signal conversion unit 284. The frequency detection unit 281 is electronically connected to the connection terminal 271. The frequency detection unit 281 is configured to sample timing control signals output from the timing control circuit 270, obtain the frequency value of the timing control signals, and send an indication signal corresponding to the frequency value to the signal processing unit 282.

The signal processing unit 282 is configured to receive the indication signal, get the signal pulse width associated with the frequency value from the storage unit 283, and generate a control signal OE corresponding to the signal pulse width. The signal conversion unit 284 is configured to receive the control signal OE from the signal processing unit 282, and generate a wave signal according to the control signal OE.

The signal conversion unit 284 includes a first transistor 285, a second transistor 286, a resistor 287, and an inverter 288. In an exemplary embodiment, the first transistor 285 and the second transistor 286 are N-channel metal oxide semiconductors (NMOS). A gate electrode of the first transistor 285 is electronically connected to the signal processing unit 282 through the inverter 288. A source electrode of the first transistor 285 is electronically connected to ground through the resistor 287. A drain electrode of the first transistor 285 is electronically connected to a source electrode of the second transistor 286. A drain electrode of the second transistor 286 is electronically connected to the power circuit 230 to receive the power supply voltage VDD. A gate electrode of the second transistor 286 is electronically connected to the signal processing unit 282. A node between the drain electrode of the first transistor 285 and the source electrode of the second transistor 286 is an output terminal 289. The output terminal 289 is configured to output wave signals to the gate driver 250.

Figure 3:
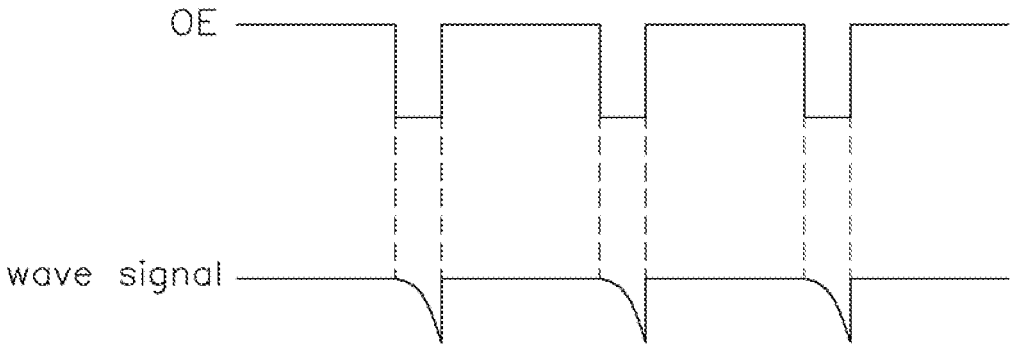
FIG. 3 is a waveform diagram of a control signal and a wave signal generated by the wave signal generation circuit shown in FIG. 2.

Referring to FIG. 3, the control signal OE is a square wave signal. When the control signal OE is in a logic high state, the first transistor 285 is turned off and the second transistor 286 is turned on. The output terminal 289 outputs the power supply voltage VDD. When the control signal OE is in a logic low state, the first transistor 285 is turned on and the second transistor 286 is turned off. The voltage of the output terminal 289 is discharged through the first transistor 285 and the resistor 287. The voltage of the output terminal 289 is gradually decreased until the state of the control signal OE is changed from the logic low to the logic high. Then, the output terminal 289 outputs a wave signal as shown in FIG. 3. The control signal OE in a logic low state can be referred to as an enable pulse.

Figure 4:
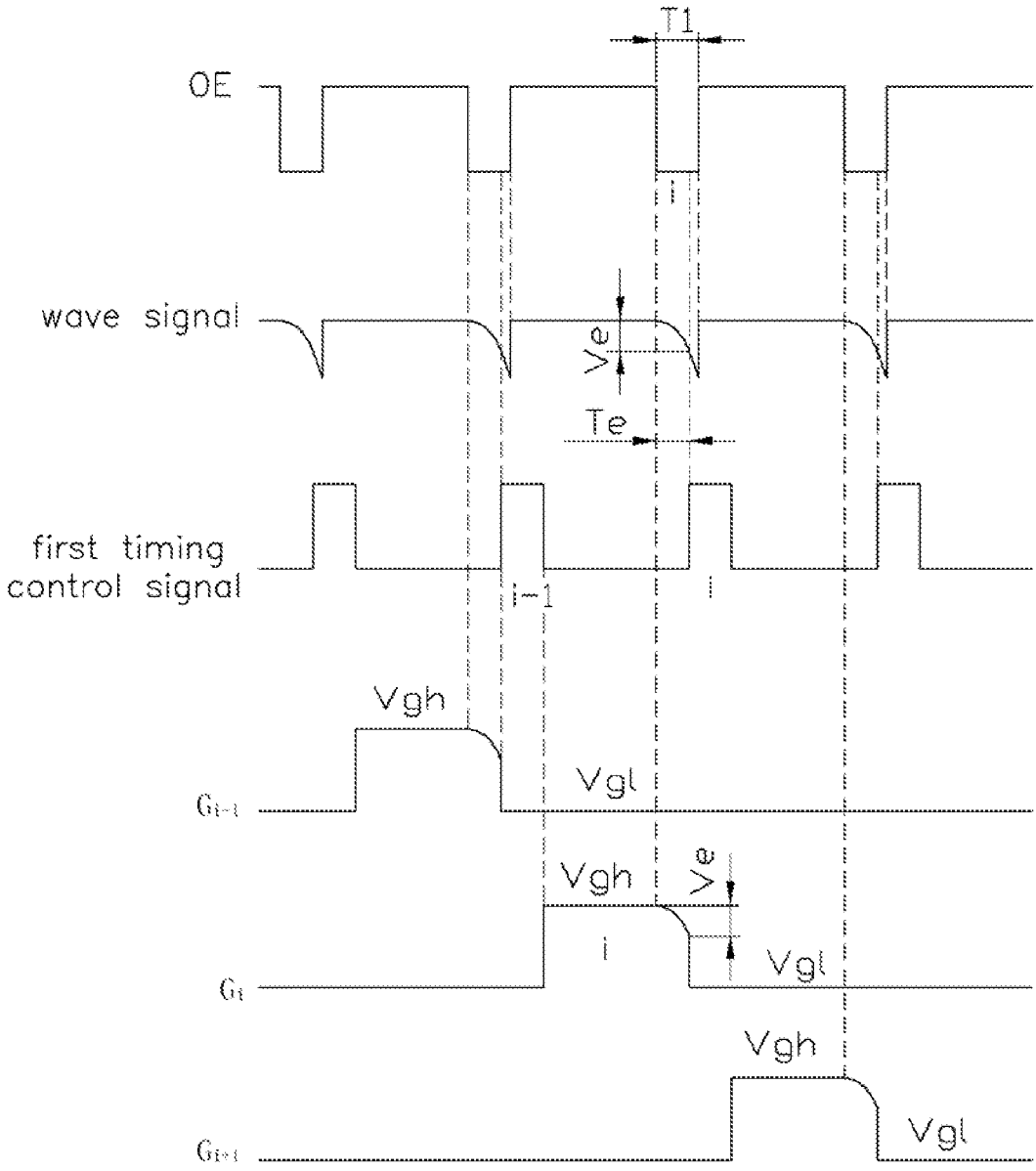
FIG. 4 is a timing diagram illustrating typical operation of the LCD shown in FIG. 1 at a refresh rate.

Referring to FIG. 4, a timing diagram illustrating typical operation of the LCD 200 at a refresh rate of 60 HZ is shown. Lines "$G_{i-1}$" "$G_i$", "$G_{i+1}$" ("i" is a natural number greater than 1) represent waveforms of three scan signals sequentially applied to three adjacent gate lines 212. The timing control circuit 270 generates a first timing control signal corresponding to the refresh rate of 60 HZ and sends the first timing control signal to the wave signal generation circuit 280, the gate driver 250, and the source driver 260. In an exemplary embodiment, the first timing control signal is a square wave signal, and the first timing control signal includes a plurality of control pulses at a high logic level.

The frequency detection unit 281 samples the first timing control signal, obtains the frequency value of the first timing control signal, and sends an indication signal corresponding to the frequency value to the signal processing unit 282. The signal processing unit 282 receives the indication signal, gets signal pulse width associated with the frequency value from the storage unit 283, and generates a control signal OE corresponding to the signal pulse width. The enable pulse width of the control signal OE is T1. As the refresh rate increases, the pulse width of the enable pulse increases. One enable pulse corresponds to one control pulse, and the enable pulse is offset in time relative to the corresponding control pulse. The signal conversion unit 284 receives the control signal OE, generates a wave signal under the control of the control signal OE, and sends the wave signal to the gate driver 250.

According to the first timing control signal and the wave signal generated under the control of the control signal OE, the gate driver 250 sends scan signals to the gate lines 212. Each of the scan signals is a voltage pulse signal. During the interval between two successive control pulses of the first timing control signal, when the first timing control signal is at a high logic level, the gate driver 250 outputs the scan signal at a minimum voltage Vgl; when the first timing control signal is at a low logic level, the gate driver 250 outputs the scan signal at a maximum voltage Vgh. In detail, when the (i-1)th control pulse of the first timing control signal ends, the voltage of the scan signal $G_i$ changes from the minimum voltage Vgl to the maximum voltage Vgh. According to the i-th enable pulse and the wave signal, the maximum voltage Vgh decreases to a middle voltage (Vgh-Ve) before the i-th control pulse of the first timing control signal starts. The time offset between the i-th enable pulse and the i-th control pulse is a fall time Te of the scan signal $G_i$. The decreased value Ve is determined by the wave signal and the fall time Te. Then, the scan signals are applied to the gate lines 212, and the source driver 260 sends data signals to the data lines 214 to drive the pixel units 216 to display images.

Figure 5:
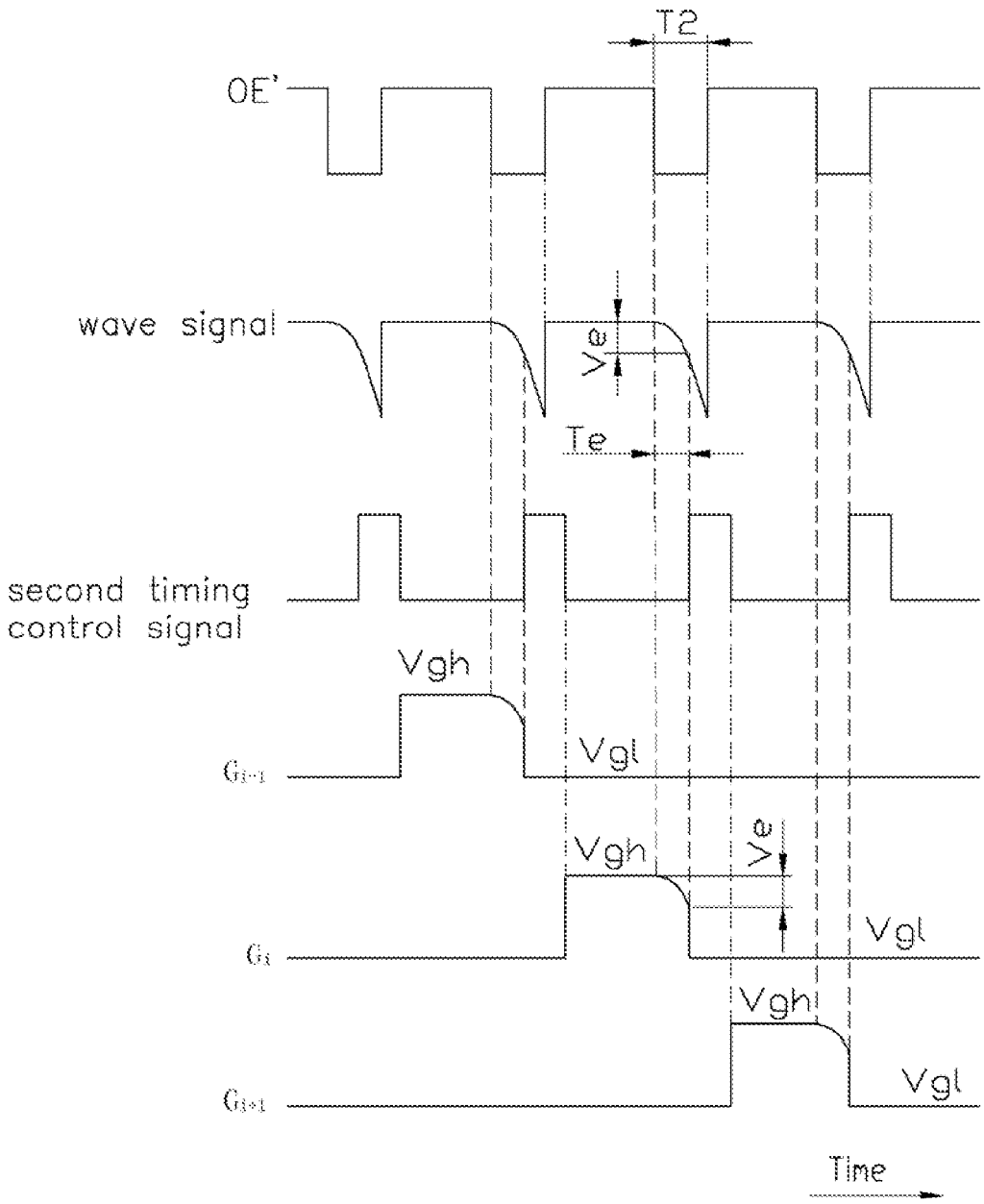
FIG. 5 is a timing diagram illustrating typical operation of the LCD shown in FIG. 1 at another refresh rate.

Referring to FIG. 5, a timing diagram illustrating typical operation of the LCD 200 at a refresh rate of 75 HZ is shown. The timing control circuit 270 generates a second timing control signal corresponding to the refresh rate of 75 HZ and sends the second timing control signal to the wave signal generation circuit 280, the gate driver 250, and the source driver 260. The frequency detection unit 281 samples the second timing control signal, obtains the frequency value of the second timing control signal, and sends an indication signal corresponding to the frequency value of the second timing control signal to the signal processing unit 282. The signal processing unit 282 receives the indication signal, gets signal pulse width associated with the frequency value of the second timing control signal from the storage unit 283, and generates a control signal OE' corresponding to the signal pulse width. The enable pulse width of control signal OE' is T2, and T2 is greater than T1. The signal conversion unit 284 receives the control signal OE', generates a wave signal under the control of the control signal OE', and sends the wave signal to the gate driver 250.

According to the second timing control signal and the wave signal generated under the control of the control signal OE', the gate driver 250 sends scan signals to the gate lines 212. As the frequency of the timing control signal increases, the enable pulse width of control signal increases, the time offset between the enable pulse and the corresponding control pulse is a fixed value Te. The discharge rate of the voltage of the output terminal 289 is invariable, and then the decreased value of the scan signals at the refresh rate of 75 HZ is Ve.

The wave signal generation circuit 280 sends wave signals to the gate driver 250, the maximum voltage Vgh of the scan signals decreases to a middle voltage of (Vgh-Ve) before reaching the minimum voltage Vgl. The magnitude of the scan signal voltage variation decreases and the impact of the scan signal voltage variation on the pixel unit 216 is reduced. The frequency of the timing control signal changes according to the variation of the refresh rate, and the wave signal generation circuit 280 outputs wave signals corresponding to the timing control signal. Therefore, the decreased value and the fall time of the scan signals are invariable at different refresh rates.

Figure 6:
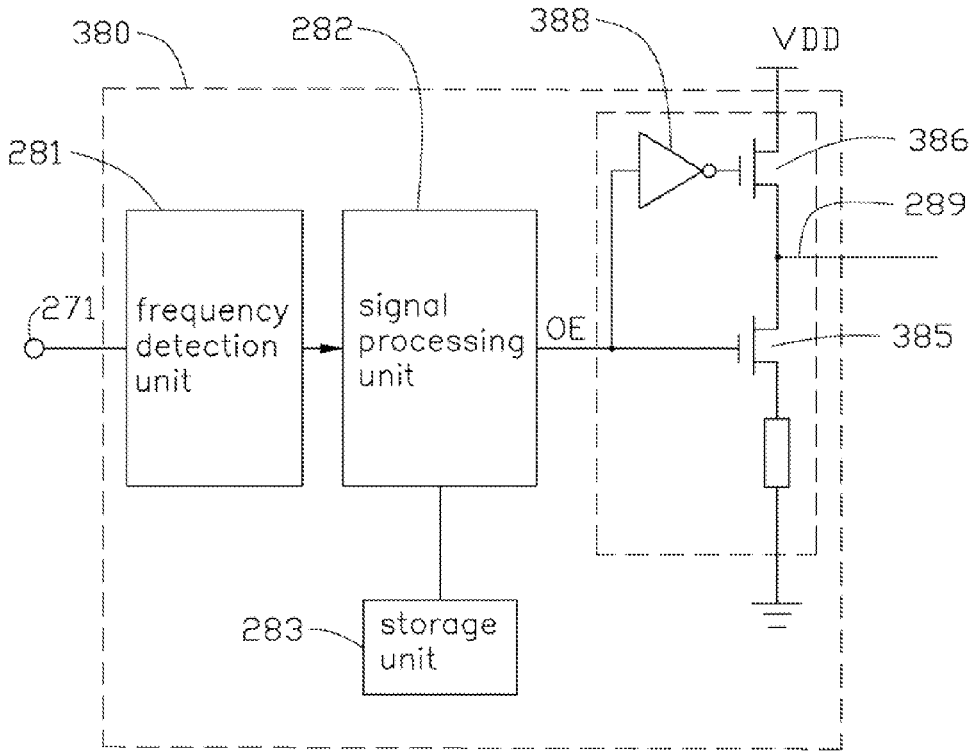
FIG. 6 is block diagram of a wave signal generation circuit shown in FIG. 1, according to a second embodiment of the present disclosure.

Referring to FIG. 6, a wave signal generation circuit 380 according to a second embodiment of the present disclosure is shown, differing from the wave signal generation circuit 280 in that a gate electrode of a first transistor 385 is electronically connected to the signal processing unit 282, and a gate electrode of a second transistor 386 is electronically connected to the signal processing unit 282 through a inverter 388.

Figure 7:
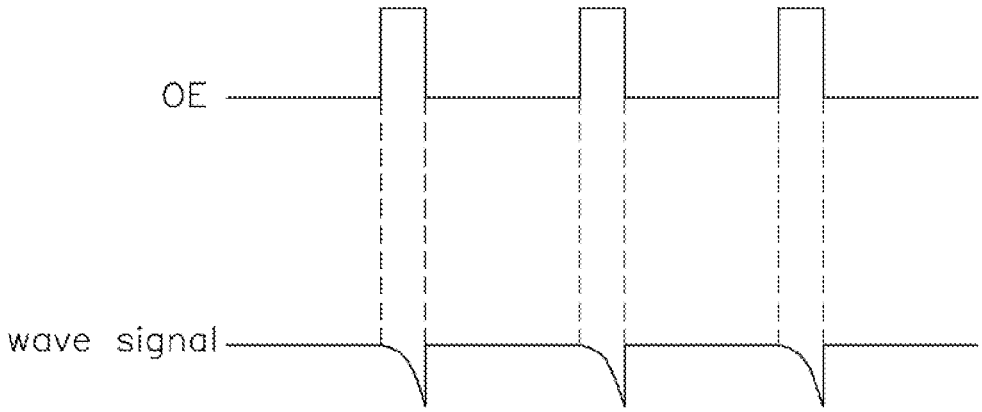
FIG. 7 is a waveform diagram of a control signal and a wave signal generated by the wave signal generation circuit shown in FIG. 6.
Figure 8:
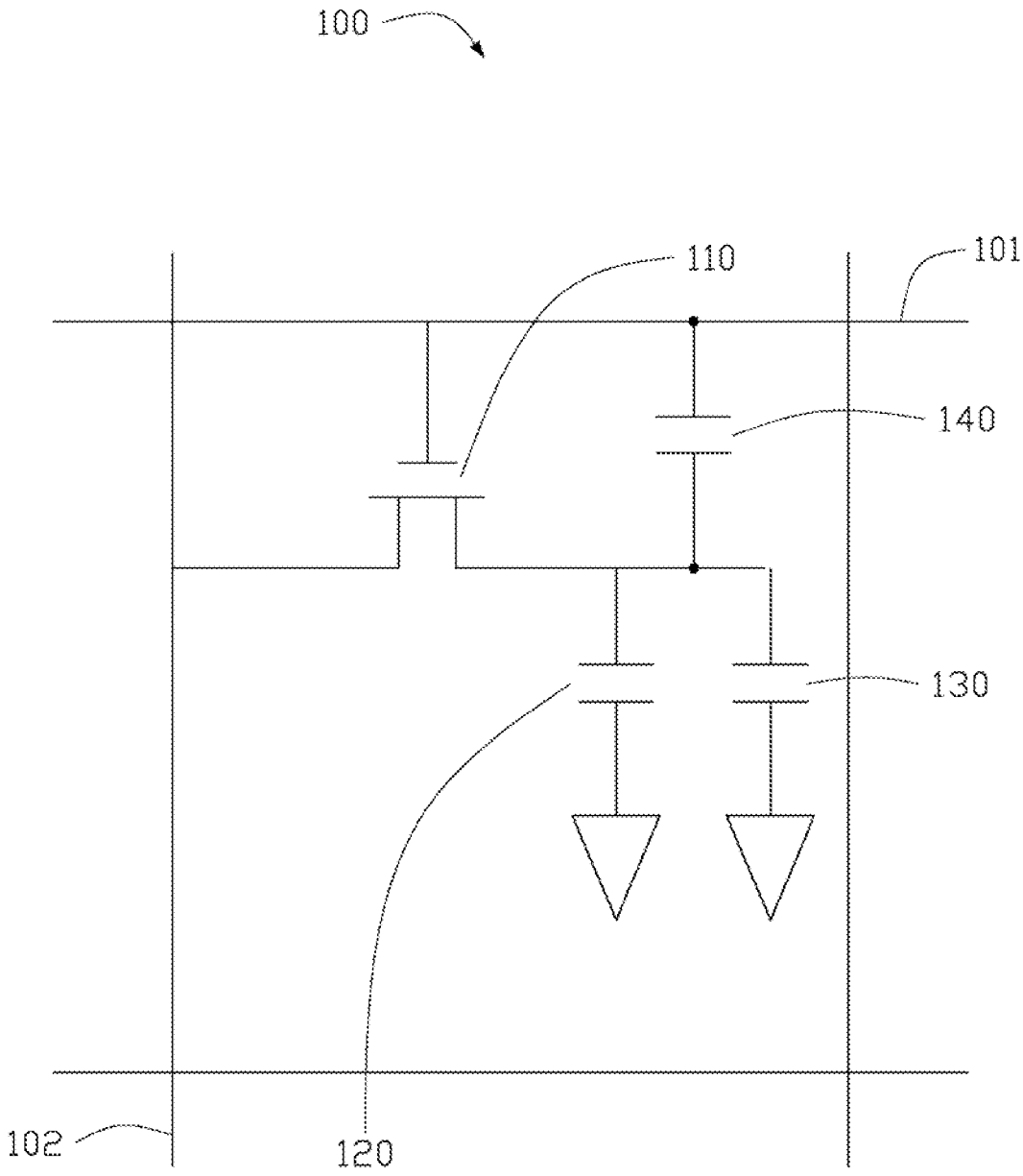
FIG. 8 (RELATED ART)
FIG. 8 is an enlarged circuit diagram of a pixel unit of a conventional LCD.

Referring to FIG. 7, waveform diagrams of a control signal OE and a wave signal generated by the wave signal generation circuit 380 are shown, the waveform of the control signal OE of the second embodiment is a reverse waveform of the control signal OE of the first embodiment. The control signal OE of the second embodiment in a logic high state can be referred to as an enable pulse.

In an alternative embodiment, the first transistor 285 and the second transistor 286 may be P-channel metal oxide semiconductors (PMOS), and the gate electrode of the first transistor 285 is electronically connected to the signal processing unit 282, and the gate electrode of the second transistor 286 is electronically connected to the signal processing unit 282 through the inverter 288.

In another alternative embodiment, the first transistor 285 may be a PMOS, and the second transistor 286 may be an NMOS. The gate electrode of the first transistor 285 and the gate electrode of the second transistor 286 are directly connected to the signal processing unit 282.

In another alternative embodiment, the storage unit 283 includes a look-up table, and signal frequencies and signal pulse widths are stored in the look-up table.

It is to be understood, the gate electrode of the transistor may be referred to as control terminal, the source electrode and the drain electrode of the transistor may be referred to as conductive terminal.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A drive circuit for a liquid crystal display, the liquid crystal display comprising a liquid crystal panel and a power circuit for providing a power supply voltage to the drive circuit; the drive circuit comprising:

a gate driver for providing scan signals to the liquid crystal panel;

a wave signal generation circuit for generating wave signals and sending the wave signals to the gate driver; and a timing control circuit for providing timing control signals to the gate driver and the wave signal generation circuit;

wherein the wave signal generation circuit generates a control signal according to the timing control signal, and generates a wave signal according to the control signal; the gate driver generates the scan signals according to the timing control signal and the wave signal; wherein before the voltage of the scan signal changes from a maximum voltage to a minimum voltage, the voltage of the scan signal decreases to a middle voltage that is greater than the minimum voltage and less than the maximum voltage during an invariable fall time of the scan signal;

wherein the control signal comprises a plurality of enable pulses, and wherein the pulse width of the enable pulse increases as the frequency of the timing control signal increases.

2. The drive circuit as claimed in claim 1, wherein the timing control signal comprises a plurality of control pulses, each enable pulse corresponds to a control pulse; the fall time is a time offset between the enable pulse and the control pulse.

3. The drive circuit as claimed in claim 1, wherein the wave signal generation circuit comprises a frequency detection unit electronically connected to the timing control circuit, the frequency detection unit configured to sample the timing control signal and obtain the frequency value of the timing control signal.

4. The drive circuit as claimed in claim 3, wherein the wave signal generation circuit further comprises a signal processing unit and a storage unit storing a plurality of signal frequencies respectively associated with a plurality of signal pulse widths, and wherein the frequency detection unit sends a indication signal corresponding to the frequency value of the timing control signal to the signal processing unit, and the signal processing unit generates the control signal corresponding to the associated signal pulse width.

5. The drive circuit as claimed in claim 4, wherein the wave signal generation circuit further comprises a signal conversion unit electronically connected to the signal processing unit, the signal conversion unit comprises a first transistor, a second transistor and a resistor; the first transistor is electronically connected to ground through the resistor, the power circuit is electronically connected to the first transistor through the second transistor; a node between the first transistor and the second transistor is an output terminal configured to output the wave signal to the gate driver.

6. The drive circuit as claimed in claim 5, wherein the first transistor and the second transistor are alternatively turned on according to the control signal.

7. The drive circuit as claimed in claim 6, wherein the signal conversion unit further comprises an inverter, either of the first transistor or the second transistor is electronically connected to the signal processing unit through the inverter.

8. The drive circuit as claimed in claim 6, wherein the first transistor comprises a control terminal and two conductive terminals, the second transistor comprises a control terminal and two conductive terminals; the power circuit is electronically connected to the resistor through the four conductive terminals; the two control terminals are electronically connected to the signal processing unit.

9. The drive circuit as claimed in claim 8, wherein either of the two control terminals is electronically connected to the signal processing unit through an inverter, and the other control terminal is directly connected to the signal processing unit.

10. The drive circuit as claimed in claim 6, wherein when the second transistor is turned on and the first transistor is turned off, the output terminal outputs the power supply voltage; when the second transistor is turned off and the first transistor is turned on, the voltage of the output terminal is discharged through the first transistor and the resistor.

11. A liquid crystal display, comprising:

a liquid crystal panel;

a drive circuit for driving the liquid crystal panel, the drive circuit comprises a gate driver, a timing control circuit and a wave signal generation circuit; and a power circuit for providing power supply voltage to the drive circuit;

wherein the timing control circuit generates a timing control signal corresponding to a refresh rate of the liquid crystal display and sends the timing control signal to the gate driver and the wave signal generation circuit; the wave signal generation circuit generates a control signal according to the timing control signal, generates a wave signal according to the control signal, and sends the wave signal to the gate driver; the gate driver generates scan signals according to the timing control signal and the wave signal; before the voltage of the scan signal changes from a maximum voltage to a minimum voltage, the voltage of the scan signal decreases to an invariable middle voltage that is greater than the minimum voltage and less than the maximum voltage during a fall time of the scan signal;

wherein the control signal comprises a plurality of enable pulses, and wherein the pulse width of the enable pulse increases as the frequency of the timing control signal increases.

12. The liquid crystal display as claimed in claim 11, wherein the timing control signal comprises a plurality of control pulses, each enable pulse corresponds to a control pulse; the fall time is a time offset between the enable pulse and the control pulse.

13. The liquid crystal display as claimed in claim 11, wherein the wave signal generation circuit comprises a frequency detection unit electronically connected to the timing control circuit, the frequency detection unit is configured to sample the timing control signal and obtain the frequency value of the timing control signal.

14. The liquid crystal display as claimed in claim 13, wherein the wave signal generation circuit further comprises a signal processing unit and a storage unit storing a plurality of signal frequencies respectively associated with a plurality of signal pulse widths, the frequency detection unit sends a indication signal corresponding to the frequency value of the timing control signal to the signal processing unit, the signal processing unit gets the signal pulse width associated with the frequency value from the storage unit, and generates the control signal corresponding to the signal pulse width.

15. The liquid crystal display as claimed in claim 14, wherein the wave signal generation circuit further comprises a signal conversion unit electronically connected to the signal processing unit, the signal conversion unit comprises a first transistor, a second transistor and a resistor; the first transistor is electronically connected to ground through the resistor, the power circuit is electronically connected to the first transistor through the second transistor; a node between the first transistor and the second transistor is an output terminal configured to output the wave signal to the gate driver.

16. The liquid crystal display as claimed in claim 15, wherein the first transistor and the second transistor are alternatively turned on according to the control signal.

17. The liquid crystal display as claimed in claim 16, wherein the signal conversion unit further comprises an inverter, either of the first transistor or the second transistor is electronically connected to the signal processing unit through the inverter.

18. The liquid crystal display as claimed in claim 16, wherein when the second transistor is turned on and the first transistor is turned off, the output terminal outputs the power supply voltage; when the second transistor is turned off and the first transistor is turned on, the voltage of the output terminal is discharged through the first transistor and the resistor.

* * * * *